US008508522B2

(12) United States Patent
Bowman et al.

(10) Patent No.: US 8,508,522 B2
(45) Date of Patent: Aug. 13, 2013

(54) DERIVATIVE SAMPLED, FAST SETTLING TIME CURRENT DRIVER

(75) Inventors: Robert J. Bowman, Fairport, NY (US); Chris J. Nassar, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 559 days.

(21) Appl. No.: 12/677,648

(22) PCT Filed: Sep. 9, 2008

(86) PCT No.: PCT/US2008/010533

§ 371 (c)(1), (2), (4) Date: Mar. 11, 2010

(87) PCT Pub. No.: WO2009/035588

PCT Pub. Date: Mar. 19, 2009

(65) Prior Publication Data

US 2010/0201670 A1 Aug. 12, 2010

Related U.S. Application Data

(60) Provisional application No. 60/971,747, filed on Sep. 12, 2007.

(51) Int. Cl.
*G09G 5/00* (2006.01)

(52) U.S. Cl.
USPC ..... 345/211; 345/204; 345/205; 345/209; 345/212; 345/213

(58) Field of Classification Search
USPC ..... 345/76, 102, 173, 204–215; 315/164; 363/16; 365/49; 323/166, 223, 234, 313, 323/315
See application file for complete search history.

(56) References Cited

U.S. PATENT DOCUMENTS

| | | | | |
|---|---|---|---|---|
| 5,726,538 | A * | 3/1998 | Jackson et al. | 315/370 |
| 7,075,528 | B2 * | 7/2006 | Sano et al. | 345/211 |
| 7,148,881 | B2 * | 12/2006 | Lee et al. | 345/173 |
| 7,394,230 | B1 * | 7/2008 | Herbert | 323/234 |
| 7,808,451 | B1 * | 10/2010 | Rutherford | 345/45 |
| 7,817,120 | B2 * | 10/2010 | Peng et al. | 345/76 |
| 7,859,501 | B2 * | 12/2010 | Levey et al. | 345/90 |
| 2002/0070717 | A1 * | 6/2002 | Pellegrino | 323/223 |
| 2002/0140412 | A1 * | 10/2002 | Maneatis | 323/313 |
| 2002/0181250 | A1 * | 12/2002 | Riggio et al. | 363/16 |
| 2003/0169241 | A1 * | 9/2003 | LeChevalier | 345/204 |
| 2004/0080471 | A1 * | 4/2004 | Kim et al. | 345/76 |

(Continued)

FOREIGN PATENT DOCUMENTS

| | | |
|---|---|---|
| CA | 2495715 | 7/2006 |
| TW | I247259 | 1/2006 |

*Primary Examiner* — Prabodh M Dharia

(74) *Attorney, Agent, or Firm* — Joseph M. Noto; Bond Schoeneck & King PLLC

(57) ABSTRACT

Methods for producing a remote current for driving a load, include one of sourcing and sinking a local current, Iref, through a distributed impedance line, at a first node thereof; the other of sourcing and sinking a remote current, Iref, through the distributed impedance line in response to the local current Iref; determining a rate change of voltage of the first node; and sourcing or sinking additional current, into or out of the first node, in response to the rate of change of voltage of the first node in order to settle the voltage on the distributed impedance line, and apparatus for providing such are disclosed.

20 Claims, 5 Drawing Sheets

(56) References Cited

U.S. PATENT DOCUMENTS

| | | | | |
|---|---|---|---|---|
| 2004/0201556 | A1 | 10/2004 | Oomori et al. | 345/76 |
| 2004/0227499 | A1* | 11/2004 | Date et al. | 323/315 |
| 2005/0035718 | A1* | 2/2005 | Lee et al. | 315/164 |
| 2005/0237284 | A1* | 10/2005 | Yaguma et al. | 345/76 |
| 2005/0243586 | A1* | 11/2005 | Chung et al. | 365/49 |
| 2006/0001613 | A1* | 1/2006 | Routley et al. | 345/76 |
| 2006/0084360 | A1 | 4/2006 | Stern | 446/397 |
| 2006/0208961 | A1 | 9/2006 | Nathan et al. | 345/44 |
| 2007/0080905 | A1* | 4/2007 | Takahara | 345/76 |
| 2008/0007512 | A1* | 1/2008 | Honbo | 345/102 |
| 2008/0100545 | A1* | 5/2008 | Hong | 345/82 |
| 2008/0122820 | A1* | 5/2008 | Umeda et al. | 345/205 |
| 2010/0118018 | A1* | 5/2010 | Stewart | 345/211 |

* cited by examiner

DERIVATIVE SAMPLED, FAST SETTLING TIME CURRENT DRIVER

CROSS-REFERENCE TO RELATED APPLICATIONS

This application claims the benefit of priority under U.S.C. §119(e) of U.S. Provisional Application Ser. No. 60/971,747 filed on Sep. 12, 2007.

BACKGROUND

The present invention relates to methods and apparatus for producing a precise and accurate current value at a remote location in response to a programmed current at a local location.

Accurate and precise current values are desirable in a number of applications, including digital-to-analog conversion, image display driving, etc.

For example, in an organic light emitting diode (OLED) display, a plurality of pixels are arranged in rows and columns, where each pixel includes two thin film transistors (TFTs), one an addressing (or switching) transistor and the other a driving (or power) transistor, a storage capacitor, and an OLED device. For activation of a given pixel of the OLED array, a scan line (row line) is selected, and a video signal is loaded on a data line (column line) and input to the driving transistor (via the addressing transistor) to control a current through the OLED device. The video signal is stored on the storage capacitor for the duration of one frame.

An OLED device emits light at intensities proportional to the currents that pass through the device. Therefore, current drive is the preferred OLED driving mode. There are, however, at least two problems that have plagued the OLED display driver industry. The wide dynamic range in OLED pixels requires very small currents at the low end of OLED luminance. The distribution of small, precise currents to remote pixel locations in the OLED array may be corrupted by systemic offset errors and leakage currents leading to non-uniform display luminance. In addition, small currents do not provide adequate drive to quickly settle voltages on column lines with significant distributed capacitance. Thus, the ability to establish the pixel illuminations for the entire array within the time available for a given video frame may be impacted. The above problems are exacerbated as display resolutions increase. Indeed, the available settling times for the array pixels reduce as the resolution increases.

Conventional display driver technology employs thin film transistor circuits to program current or program voltage at the given pixel sites. In current programming, a current is sent to the OLED pixel through a current mirror at the site. In voltage programming, a voltage is converted to a pixel drive current through a pixel drive transistor at the pixel site. These techniques demonstrate reasonable stability but suffer from the aforementioned intensity non-uniformities and slow settling times (particularly at low currents). While voltage programming techniques may tend to settle the pixel site more quickly than current programming, such techniques suffer from systemic transistor mismatches and OLED drive current shifts as the OLED ages.

The problems of illumination non-uniformities and poor settling times have rendered the conventional current techniques for driving OLED arrays unsatisfactory. As a result, the commercial display industry has been slow to adopt OLED technology.

Thus, there is a need in the art for methods and apparatus for providing precise currents to the OLED pixel sites that are accurate over a wide dynamic range, exhibit fast settling times, and maintain accuracy as the OLED devices age.

SUMMARY

Methods and apparatus according to one or more embodiments of the present invention provide for producing a remote current for driving a load. The methods and apparatus provide for: one of sourcing and sinking a local current, Iref, through a distributed impedance line, at a first node thereof; the other of sourcing and sinking a remote current, Iref, through the distributed impedance line in response to the local current Iref; determining a rate of change of voltage of the first node; and sourcing or sinking additional current, into or out of the first node, in response to the rate of change of voltage of the first node in order to settle the voltage on the distributed impedance line.

The methods and apparatus may further provide for mirroring the remote current Iref to produce a remote drive current Iref for driving a load. The load may be an organic light emitting diode (OLED). When used in an OLED array, the methods and apparatus may further provide for varying the local current Iref in response to a command signal at a rate proportional to a video frame rate.

The methods and apparatus may further provide for: sourcing current into the first node when the rate of change of voltage of the first node is positive; sinking current from the first node when the rate of change of voltage of the first node is negative; and varying a magnitude of the current into or out of the first node as a function of the time rate of change of voltage measured on the first node.

The methods and apparatus may further provide for: producing an intermediate signal representing a derivative of the voltage of the first node; sampling and holding the intermediate signal for a predetermined period of time; varying a magnitude of the intermediate signal to produce a control signal; and producing the source or sink current, into or out of the first node as a function of the control signal.

The frequency of the sample and hold may be between about 1 to 10 MHz, preferably 4-5 MHz, with a pulse width of about 50 ns. This may result in a settling time of about 1 us.

In accordance with one or more aspects of the present invention, a current driver circuit includes: a local reference current circuit coupled to a first node at one end of a distributed impedance line and operable to produce a local current, Iref through the distributed impedance line; a derivative drive circuit operable to source current, or sink current, into or out of the first node in response to a rate of change of voltage of the first node; and a remote current drive circuit coupled to a second node at an opposite end of the distributed impedance line and operable to: (i) produce a remote current Iref through the distributed impedance line in response to the local current Iref, and (ii) mirror the remote current Iref to produce a remote drive current Iref for driving a load.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1:
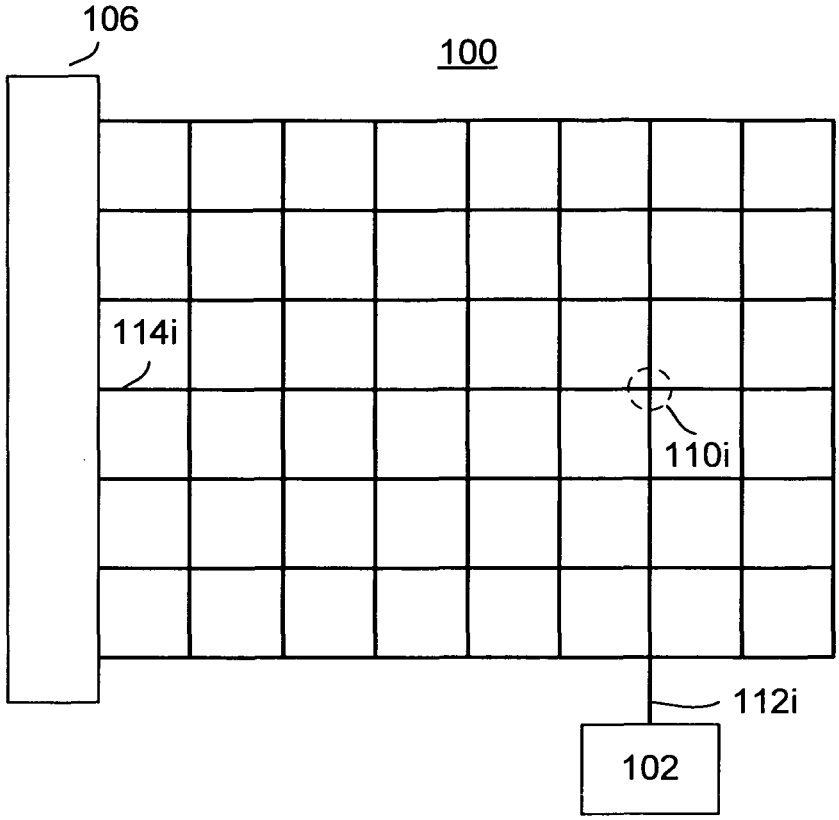
FIG. 1 is a schematic diagram of a display array of pixels each having a current driver in accordance with one or more aspects of the present invention.

With reference to the drawings, wherein like numerals indicate like elements, there is shown in FIG. 1 a schematic diagram of a display array 100, such as an OLED array, having a plurality of pixels 110 arranged in rows and columns, a local current reference circuit 102, and additional circuitry 106, such as row driver circuits, etc. as would be apparent to one skilled in the art. Each pixel 110 of each column 112, such as pixel (or cell) 110*i*, includes a number of circuit components for addressing the pixel 110, storing an illumination valued for the pixel 110, and driving current through an associated OLED device.

For activation of a given pixel 110 of the OLED array 100, a scan (row) line 114, such as line 114*i*, is selected and an illumination level (derived from the desired frame of video information) is applied on the particular column line, such as column line 112*i* associated with pixel 110*i*. The selection of the row line 114*i* activates the addressing circuitry of the pixel 110*i* such that the illumination level is stored in the pixel 110*i* (usually by way of one or more capacitors) and used to set a current level for application to the OLED device. The OLED device of the pixel 110 emits light at intensities proportional to the currents that pass through the device.

Figure 2:
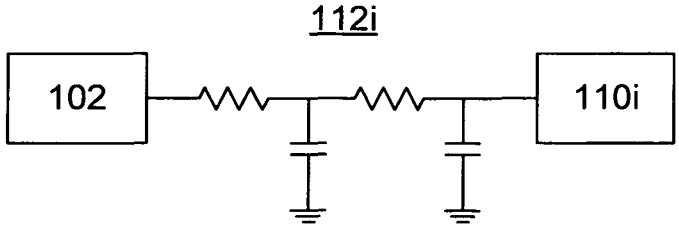
FIG. 2 is a schematic diagram of an equivalent circuit of a column line of the display array of FIG. 1.

The above process is repeated for each pixel 110 of the array 100 for each frame, at a rate that is typically 30 frames per second (33 ms per frame). Thus, in addition to the desirability of driving a precise current into the OLED device, the rates at which the column lines 112 must ramp from initial values to the final, programmed levels are significant. With reference to FIG. 2, the equivalent circuit for each of the column lines 112 is a distributed impedance circuit, such as an R-C circuit. Thus, instantaneous changes in the current through the line 112, and/or changes in the voltage potential on the line 112, are not possible. In accordance with one or more aspects of the present invention, however, the precision of, and rate of change of, the programmed current on the column line 112—and the resultant current available to and/or flowing through the OLED—are addressed in ways not heretofore contemplated in the art.

Figure 3:
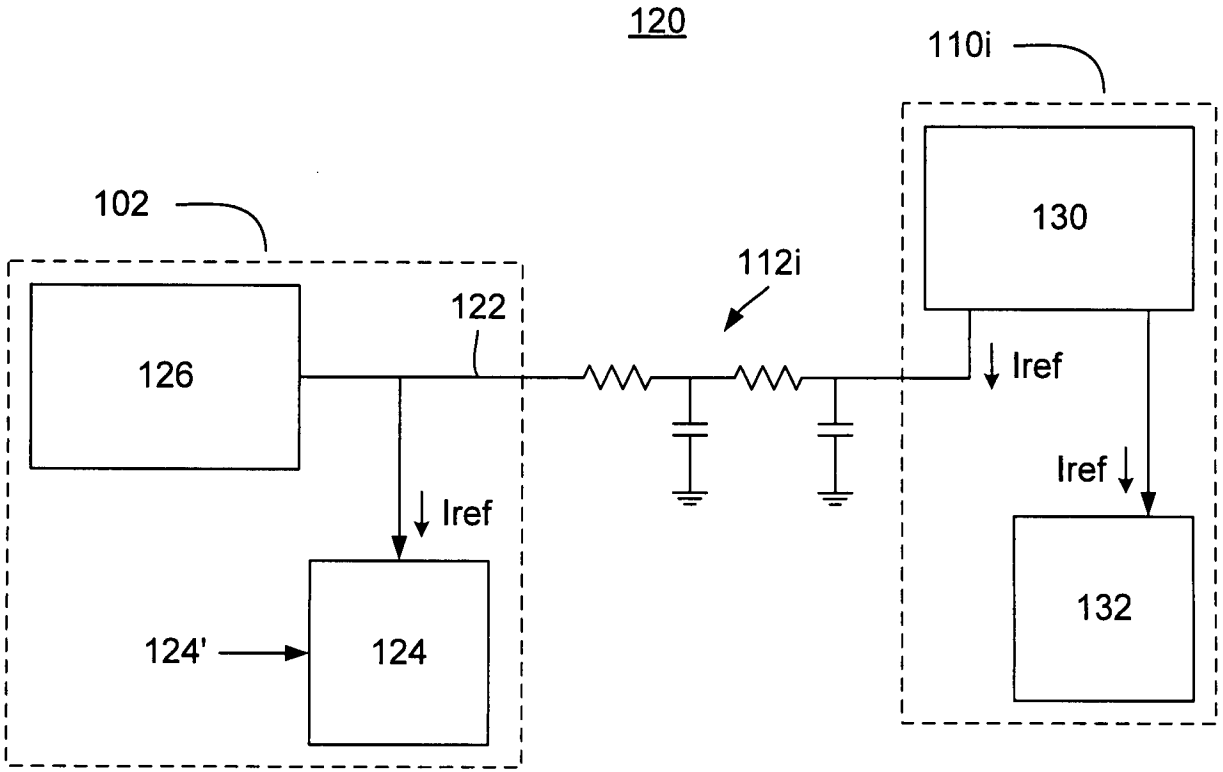
FIG. 3 is a block diagram of a current driver in accordance with one or more aspects of the present invention.

FIG. 3 is a block diagram of a current driver circuit 120 in accordance with one or more aspects of the present invention. The current driver circuit 120 includes the aforementioned local current reference circuit 102 and a remote current driver circuit within the pixel site 110*i*. It is understood that each column line 112 may include a dedicated local current reference circuit 102 or a single local current reference circuit 102 may be shared by more than one column line 112. In the latter case, a multiplexing circuit (not shown) may be employed to couple a given column line 112 to the local current reference circuit 102 for a particular time interval during which the column line 112 is driven to the desired current and voltage levels. Thereafter, the multiplexer couples a next column line 112 to the local current reference circuit 102 for another interval, and so on. It is also understood that each pixel 110 of the array 100 includes a dedicated remote current driver circuit and OLED device.

The local current reference circuit 102 includes a precision current reference 124, and a derivative drive circuit 126. The precision current reference 124 either sources or sinks a current, Iref, representing the desired illumination level for a given pixel 110*i*, into or out of an end (or node) 122 of the column line 112*i*. The particular level of Iref is computed using graphics processing techniques known in the art and the specific value is controlled via programming line 124'. As will be discussed in more detail below, the derivative drive circuit 126 operates to quickly settle the voltage on the column line 112*i*, preferably within about 1 us or so.

Assuming that the precision current reference 124 sinks current, the pixel site 110 produces a remote current Iref and sources same into an opposite end of the column line 112*i*. The pixel 110*i* includes a current mirror circuit 130 that is operable to produce the remote current Iref through the column line 112*i* in response to the local current Iref, and to mirror the remote current Iref to produce a remote drive current Iref for driving the load 132 (e.g., the OLED pixel). In an alternative embodiment, the precision current reference 124 may source current and the current mirror circuit 130 may sink the remote current Iref.

Without the derivative drive circuit 126, the settling time of the column line 112*i* might be excessive, particularly at low magnitudes of Iref. With the derivative drive circuit 126, however, the settling time on the column line 112*i* is significantly reduced. The derivative drive circuit 126 is operable to: (i) source current into the node 122 when the rate of change of voltage of the node 122 is positive, and (ii) sink current from the node 122 when the rate of change of voltage of the node 122 is negative.

Figure 4:
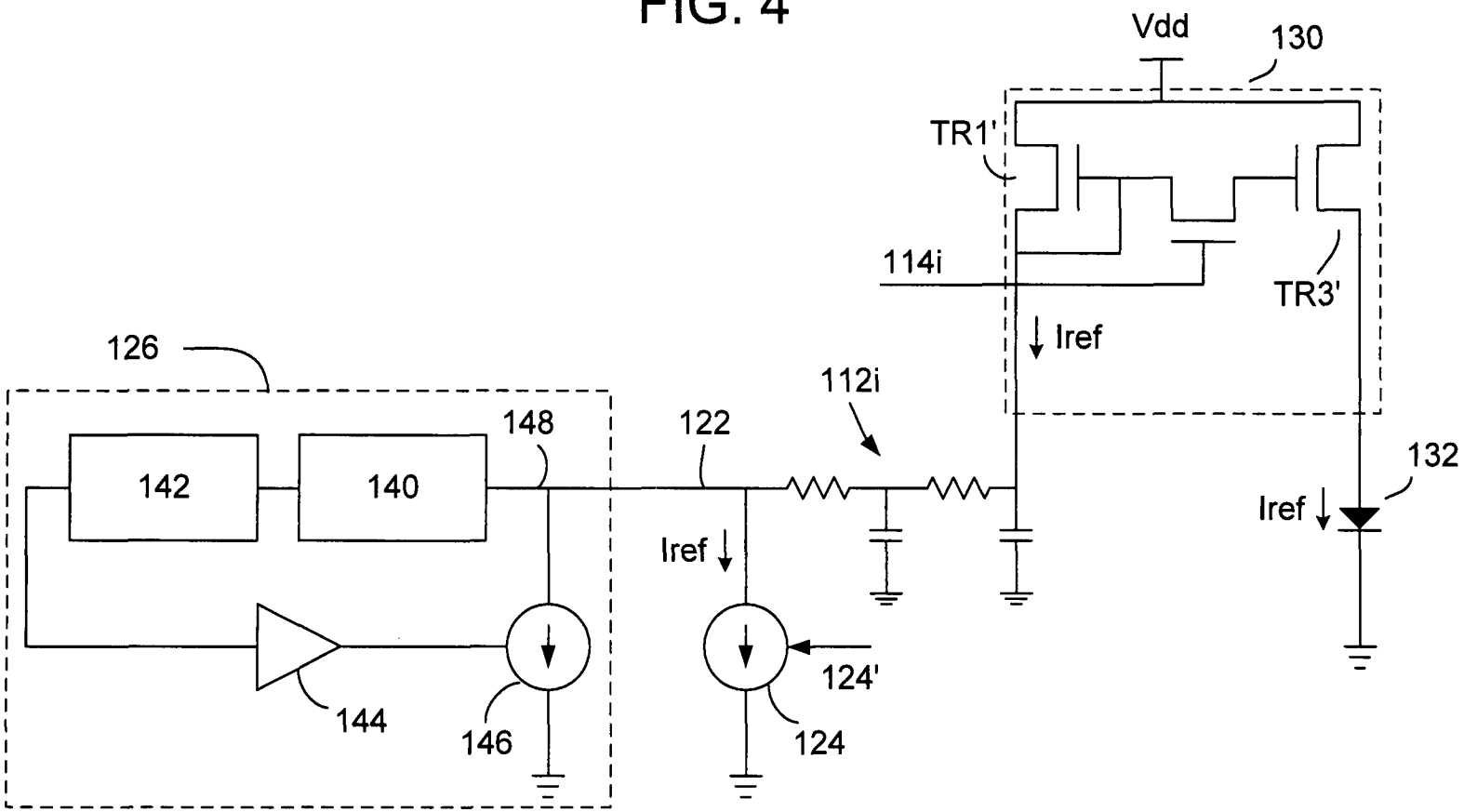
FIG. 4 is a partial block diagram and partial circuit diagram of an exemplary circuit suitable for implementing the current driver of FIG. 3.

Reference is now made to FIG. 4, which is a more detailed schematic diagram of the current driver circuit 120. In accordance with one or more embodiments, the derivative drive circuit 126 includes: a voltage differentiator circuit 140, a sample and hold circuit 142, a gain circuit 144, and a transconductance circuit 146. The voltage differentiator circuit 140 is operable to produce an intermediate signal representing a derivative of the voltage of the node 122. The sample and hold circuit 142 is operable to sample the intermediate signal and hold same for a predetermined period of time. By way of example, the sample and hold circuit 142 may operate at a frequency of about 1 to 10 MHz, preferably about 4-5 MHz. The gain circuit 144 is operable to vary a magnitude of the sampled and held intermediate signal to produce a control signal to the transconductance circuit 146. The transconductance circuit 146 is operable to produce the current into or out of the node 122 as a function of the control signal.

A change in the programmed, local current Iref, set by the control signal on line 124', will cause the voltage on node 122 (and other nodes of the column line 112*i*) to increase or decrease. Thus, there will be an associated direction and time variant rate of change of the voltage on the node 122 in response to the change in the local current Iref. Without the derivative drive circuit 126, the settling time of the column line 112*i* will depend on the magnitude of the local current Iref and the specifics of the distributed impedance of the column line 122*i*. The derivative drive circuit 126 aids in settling the column line 112*i*, and renders secondary the effect of the magnitude of the local current Iref. The function of sourcing current into the node 122 when the rate of change of the voltage is positive (i.e., when the voltage on the node 122 wants to settle to a higher voltage) tends to increase the voltage of the node 122 toward the higher settling voltage. Similarly, the function of sinking current from the node 122 when the rate of change of the voltage is negative (i.e., when the voltage on the node 122 wants to settle to a lower voltage) tends to decrease the voltage of the node 122 toward the lower settling voltage.

Figure 5:
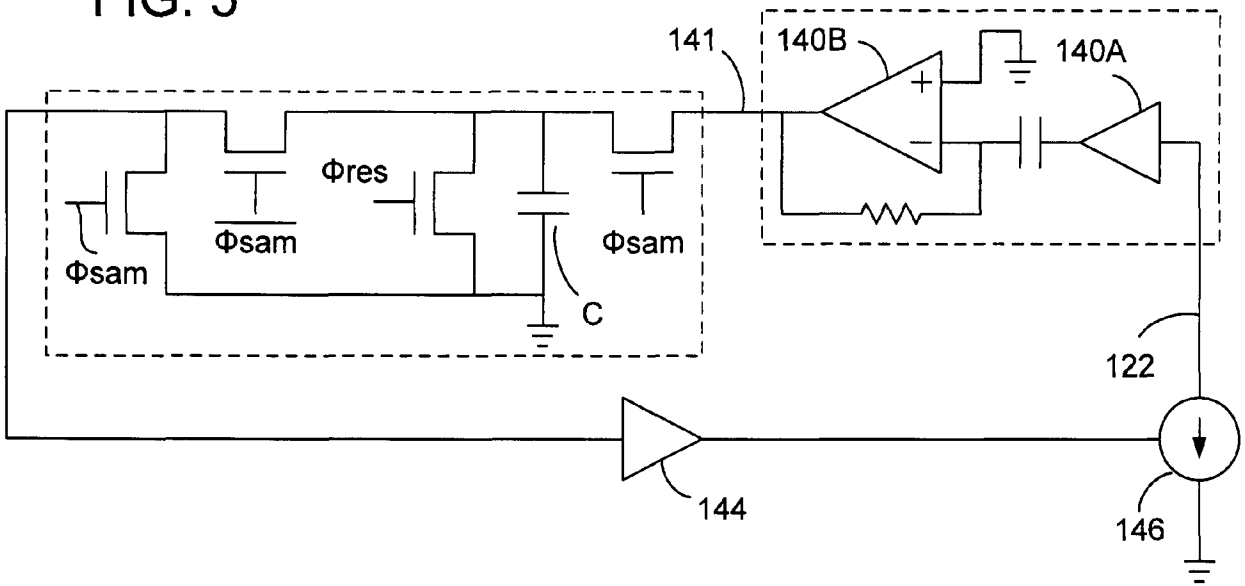
FIG. 5 is a circuit diagram of an exemplary circuit suitable for implementing a derivative drive circuit of the current driver of FIGS. 3-4.
Figure 6:
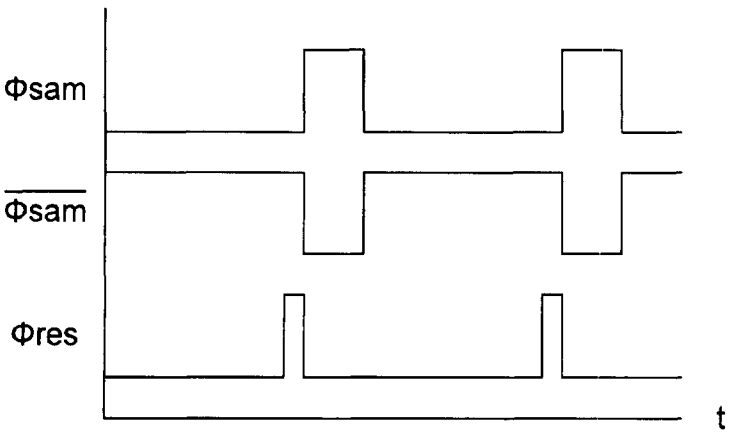
FIG. 6 is a graph illustrating timing relationships among some of the voltage nodes of the circuit of FIG. 5.

Reference is now made to FIGS. 5-6. FIG. 5 is a circuit diagram of an exemplary circuit suitable for implementing the derivative drive circuit 126. FIG. 6 is a graph illustrating timing relationships among some of the voltage nodes of the sample and hold circuit 142 of the derivative drive circuit 126. The sample and hold circuit 142 and the transconductance circuit 146 operate to pulse the current into or out of the node 122. The voltage differentiator circuit 140 may be implemented using a buffer 140A, driving a differential amplifier 140B. The differential amplifier 140B is in a configuration to produce the intermediate signal 141 proportional to the time rate of change of voltage on node 122. The sample and hold circuit 142 is implemented using a number of MOSFETs. A MOSFET coupled in series with the output of the differential amplifier 140B drives storage capacitor C. The series MOSFET is gated on and off with signal ϕsam, which applies the intermediate signal 141 to the storage capacitor C. Once the storage capacitor is charged, a series MOSFET gated with the inverse of ϕsam applies the stored (sampled) intermediate voltage to the gain circuit 144. When the predetermined period of the pulse is complete, the circuit is reset by gating the shunt MOSFET with signal ϕres. This process repeats until the voltage on the column line 112*i* settles. The predetermined period of the pulse is preferably at a higher frequency than the settling period. For example, when a settling time of about 1 us is desired, then the sample and hold circuit 142 should operate at a frequency higher than about 1 MHz, such as 2-5 MHz or higher. The pulse width may be, for example, about 50 ns—although other pulse widths are also within the scope of the invention.

Figure 7:
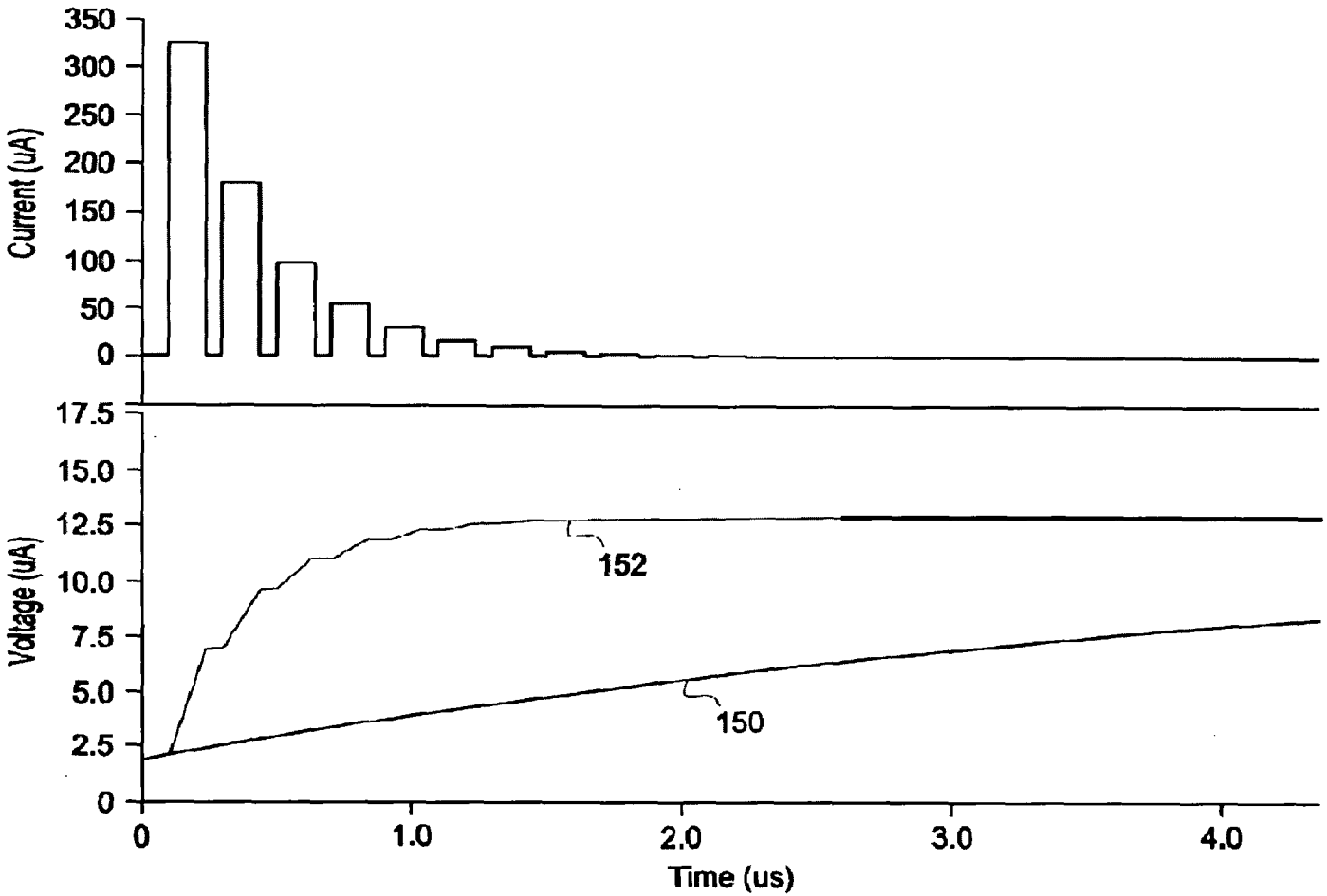
FIG. 7 is a graph illustrating experimental results obtained by measuring the timing of the current driver of the present invention.

FIG. 7 is a graph illustrating experimental results obtained by measuring the timing of the current driver 120 of the present invention. The X-axis represents time, the upper Y-axis represents the pulsed current into node 122, and the lower Y-axis represents the voltage at node 122. The voltage plot 150 is the voltage waveform that would occur at node 122 in response to an instantaneous change in the local current Iref without the derivative drive circuit 126. The voltage plot 152 is the voltage waveform that occurs at node 122 in response to an instantaneous change in the local current Iref with the derivative drive circuit 126 in operation. When the instantaneous voltage on node 122 is far from the settled voltage of about 12.5 V, the peak magnitude of the pulsed current into node 122 from the derivative drive circuit 126 is relatively large (e.g., about 325 uA). The magnitude of the pulsed current into or out of node 122 varies as a function of a difference between the ultimate settled voltage (12.5 V) and the actual (or instantaneous) voltage on node 122. Thus, the peak current over the first five or so pulses drops significantly and in proportion to the rise in the voltage on node 122 toward the settled voltage of 12.5 V. From voltage plot 152, the settling time of the column line 112*i* is about 1 us, significantly shorter than without the derivative drive circuit 126.

In accordance with an alternative embodiment of the present invention, additional circuitry for providing current drive to the load 132 may be employed in combination with one or more embodiments herein. In particular, one or more embodiments of the invention disclosed in the following patent application may be employed in combination with one or more embodiments herein: METHODS AND APPARATUS FOR PRODUCING PRECISION CURRENT OVER A WIDE DYNAMIC RANGE, U.S. Ser. No. 60/971,738, filed Sep. 12, 2007, the entire disclosure of which is hereby incorporated by reference. With such a combination the 1:K and K:1 ratio current scaling would improve the settling time on the column line 112. The cascode mirror drive circuit at the pixel site 110 tolerates variation in the OLED pixel terminal voltage to maintain current precision.

The foregoing has demonstrated that the various aspects of the present invention have application in OLED arrays; however, one or more aspects of the invention have application in other technical areas, indeed in any application requiring precise currents over a wide dynamic range. For example, applications in which micro-power current levels are used in digital-to-analog converters (DACs). Indeed, employing the current driver of the present invention in a DAC (as would be readily apparent to a skilled artisan from the teaching herein), a 10 bit current DAC would generate accurate current outputs that settle quickly. Another application of the invention is in circuits used to mimic the massively parallel connections of the biological nervous system. These circuits are designed to distribute low value, precise currents, over a wide dynamic range. The current driver of the present invention would be readily adaptable by a skilled artisan from the teaching herein to provide the nano-ampere levels of current over these parallel connections with resolutions to one part in a thousand.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A current driver circuit, comprising:

a local reference current circuit coupled to a first node at one end of a distributed impedance line and operable to produce a local current, Iref through the distributed impedance line;

a derivative drive circuit operable to source current, or sink current, into or out of the first node in response to a rate of change of voltage of the first node; and a remote current drive circuit coupled to a second node at an opposite end of the distributed impedance line and operable to: (i) produce a remote current Iref through the distributed impedance line in response to the local current Iref, and (ii) minor the remote current Iref to produce a remote drive current Iref for driving a load.

2. The driver circuit of claim 1, further comprising a controllable current source operable to produce the local current Iref in response to a command signal.

3. The driver circuit of claim 1, wherein the derivative drive circuit is operable to source current into the first node when the rate of change of voltage of the first node is positive.

4. The driver circuit of claim 1, wherein the derivative drive circuit is operable to sink current from the first node when the rate of change of voltage of the first node is negative.

5. The driver circuit of claim 1, wherein the derivative drive circuit is operable to vary a magnitude of the current into or out of the first node as a function a of a time rate of change of voltage measured on the first node.

6. The driver circuit of claim 1, wherein the derivative drive circuit includes:

a voltage differentiator circuit operable to produce an intermediate signal representing a derivative of the voltage of the first node;

a sample and hold circuit operable to sample the intermediate signal and hold same for a predetermined period of time;

a gain circuit operable to vary a magnitude of the intermediate signal to produce a control signal; and a transconductance circuit operable to produce the source or sink current, into or out of the first node as a function of the control signal.

7. The driver circuit of claim 6, wherein sample and hold circuit operates at a frequency of about 1 to 10 MHz.

8. The current driver circuit of claim 1, wherein a settling time of the distributed impedance line is about 1 us.

9. A current driver circuit for an organic light emitting diode (OLED) array, comprising:

a local reference current circuit coupled to a first node at one end of a column line of the OLED array and operable to produce a local current, Iref through the column line;

a derivative drive circuit operable to source current, or sink current, into or out of the first node in response to a rate of change of voltage of the first node; and a remote current drive circuit coupled to a second node at an opposite end of the column line of the OLED array and operable to: (i) produce a remote current Iref through the column line in response to the local current Iref, and (ii) mirror the remote current Iref to produce a remote drive current Iref for driving an OLED at a given pixel of the OLED array.

10. The driver circuit of claim 9, further comprising a controllable current source operable to produce the local current Iref in response to a command signal at a rate proportional to a video frame rate.

11. The driver circuit of claim 9, wherein the derivative drive circuit is operable to:

source current into the first node when the rate of change of voltage of the first node is positive;

sink current from the first node when the rate of change of voltage of the first node is negative; and vary a magnitude of the current into or out of the first node as a function of a magnitude of the rate of change of voltage of the first node.

12. The driver circuit of claim 9, wherein the derivative drive circuit includes:

a voltage differentiator circuit operable to produce an intermediate signal representing a derivative of the voltage of the first node;

a sample and hold circuit operable to sample the intermediate signal and hold same for a predetermined period of time;

a gain circuit operable to vary a magnitude of the intermediate signal to produce a control signal; and a transconductance circuit operable to produce the source or sink current, into or out of the first node as a function of the control signal.

13. A method of producing a remote current for driving a load, comprising:

one of sourcing and sinking a local current, Iref, through a distributed impedance line, at a first node thereof;

the other of sourcing and sinking a remote current, Iref, through the distributed impedance line in response to the local current Iref;

determining a rate of change of voltage of the first node; and sourcing or sinking additional current, into or out of the first node, in response to the rate of change of voltage of the first node in order to settle the voltage on the distributed impedance line.

14. The method of claim 13, further comprising minoring the remote current Iref to produce a remote drive current Iref for driving a load.

15. The method of claim 14, wherein the load is an organic light emitting diode (OLED).

16. The method of claim 13, further comprising varying the local current Iref in response to a command signal at a rate proportional to a video frame rate.

17. The method of claim 13, further comprising at least one of:

sourcing current into the first node when the rate of change of voltage of the first node is positive;

sinking current from the first node when the rate of change of voltage of the first node is negative; and varying a magnitude of the current into or out of the first node as a function of a difference between a settled voltage and an instantaneous voltage of the first node.

18. The method of claim 13, further comprising:

producing an intermediate signal representing a derivative of the voltage of the first node;

sampling and holding the intermediate signal for a predetermined period of time;

varying a magnitude of the intermediate signal to produce a control signal; and producing the source or sink current, into or out of the first node as a function of the control signal.

19. The method of claim 18, wherein a frequency of the sample and hold step is about 1 to 10 MHz.

20. The method of claim 13, wherein a settling time of the distributed impedance line is about 1 us.

* * * * *

UNITED STATES PATENT AND TRADEMARK OFFICE

CERTIFICATE OF CORRECTION

PATENT NO. : 8,508,522 B2
APPLICATION NO. : 12/677648
DATED : August 13, 2013
INVENTOR(S) : Robert J. Bowman and Chris J. Nassar It is certified that error appears in the above-identified patent and that said Letters Patent is hereby corrected as shown below:

In the Claims:

Column 6, Claim 1, line 53: replace “minor” with --mirror--

Column 6, Claim 5, line 66 should read: out of the first node as a function of a time rate of change Column 8, Claim 14, line 21: replace “minoring” with --mirroring--

Signed and Sealed this
Seventeenth Day of December, 2013

Margaret A. Focarino

Margaret A. Focarino
*Commissioner for Patents of the United States Patent and Trademark Office*